US011022907B2

(12) United States Patent
Katsumata

(10) Patent No.: US 11,022,907 B2
(45) **Date of Patent: *Jun. 1, 2021**

(54) IMAGE FORMING APPARATUS, TONER CARTRIDGE SET, TONER IMAGE, AND IMAGE FORMING METHOD

(71) Applicants: KABUSHIKI KAISHA TOSHIBA, Tokyo (JP); TOSHIBA TEC KABUSHIKI KAISHA, Tokyo (JP)

(72) Inventor: Tsutomu Katsumata, Ito Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/811,113

(22) Filed: Mar. 6, 2020

(65) Prior Publication Data

US 2020/0209777 A1 Jul. 2, 2020

Related U.S. Application Data

(60) Continuation of application No. 16/216,729, filed on Dec. 11, 2018, now Pat. No. 10,620,559, which is a (Continued)

(51) Int. Cl.
*G03G 9/09* (2006.01)
*G03G 15/01* (2006.01)
(Continued)

(52) U.S. Cl.
CPC ..... *G03G 15/0105* (2013.01); *G03G 9/08755* (2013.01); *G03G 9/08782* (2013.01); (Continued)

(58) Field of Classification Search
CPC ..... G03G 9/0926; G03G 9/08755; G03G 9/08782; G03G 15/0126
See application file for complete search history.

(56) References Cited

U.S. PATENT DOCUMENTS 10,073,367 B1 9/2018 Moriya
10,663,877 B2 * 5/2020 Katsumata ..... G03G 9/08797
(Continued)

FOREIGN PATENT DOCUMENTS

EP 3373072 A1 9/2018
JP 2005107092 A 4/2005

OTHER PUBLICATIONS

Diamond, "Handbook of Imaging Materials," Marcel Dekker, NY, NY 1991.*

(Continued)

*Primary Examiner* — Peter L Vajda
(74) *Attorney, Agent, or Firm* — Kim & Stewart LLP

(57) ABSTRACT

An image forming apparatus includes a first image forming unit for forming a first image on a sheet using a first toner. The first toner includes at least two fluorochromes which have a fluorescence peak in a wavelength range different from one another. A second image forming unit is configured to form a second image on the sheet using a second toner. The second toner includes a visible colored pigment. A softening point temperature of the first toner, as measured by differential scanning calorimetry, is higher than a softening point temperature of the second toner, as measured by differential scanning calorimetry.

20 Claims, 2 Drawing Sheets

Related U.S. Application Data division of application No. 15/889,652, filed on Feb. 6, 2018, now Pat. No. 10,663,877.

(51) Int. Cl.
*G03G 9/087* (2006.01)
*G03G 15/08* (2006.01)

(52) U.S. Cl.
CPC ..... *G03G 9/08795* (2013.01); *G03G 9/08797* (2013.01); *G03G 9/09* (2013.01); *G03G 9/0906* (2013.01); *G03G 9/0924* (2013.01); *G03G 9/0926* (2013.01); *G03G 15/0865* (2013.01)

(56) References Cited

U.S. PATENT DOCUMENTS

| | | | |
|---|---|---|---|
| 2009/0059252 | A1 | 3/2009 | Coyle et al. |
| 2013/0071133 | A1 | 3/2013 | Okabayashi et al. |
| 2013/0189457 | A1 | 7/2013 | Skaggs et al. |
| 2014/0272339 | A1 | 9/2014 | Tyagi et al. |
| 2015/0309435 | A1 | 10/2015 | Kuroyama et al. |
| 2019/0243273 | A1 | 8/2019 | Katsumata |

OTHER PUBLICATIONS

Extended European Search Report dated Jun. 6, 2019, mailed in counterpart European Application No. 191534726.6, 6 pages.

* cited by examiner

| | FIRST FLUORO-CHROME | SECOND FLUORO-CHROME | THIRD FLUORO-CHROME | OUTPUT METHOD | a+b+c (MASS%) | $T_{m1}$ [°C] | $T_{m2}$ [°C] | $T_{m1}-T_{m2}$ [°C] | $T_{mp1}$ [°C] | $T_{mp2}$ [°C] | $T_{mp1}-T_{mp2}$ [°C] | LOWEST FIXING TEMPERATURE | VISIBILITY WHEN IRRADIATED WITH ULTRAVIOLET RAY | NON-VISIBILITY IN VISIBLE LIGHT | LOW TEMPERATURE FIXING PROPERTY |
|---|---|---|---|---|---|---|---|---|---|---|---|---|---|---|---|
| | ADDITION AMOUNT (MASS%) a | ADDITION AMOUNT (MASS%) b | ADDITION AMOUNT (MASS%) c | | | | | | | | | | | | |
| EXAMPLE1 | 0.9 | 1.4 | 2.7 | MONOCHROME (MIXED) | 5 | 115 | 110 | 5 | 80 | 70 | 10 | 110 | ○ | ○ | ○ |
| EXAMPLE2 | 0.6 | 1.9 | 2.5 | MONOCHROME (MIXED) | 5 | 105 | 90 | 15 | 90 | 90 | 0 | 112 | ○ | ○ | ○ |
| EXAMPLE3 | 0.4 | 2.3 | 2.3 | MONOCHROME (OVERLAP) | 5 | 120 | 90 | 30 | 95 | 70 | 25 | 115 | ○ | ◎ | ○ |
| EXAMPLE4 | 0.6 | 1.5 | 2.4 | MONOCHROME (OVERLAP) | 4.5 | 110 | 100 | 10 | 85 | 80 | 5 | 110 | ○ | ○ | ○ |
| EXAMPLE5 | 0.4 | 1.9 | 2.6 | MONOCHROME (OVERLAP) | 4.9 | 120 | 100 | 20 | 90 | 70 | 20 | 116 | ○ | ○ | ○ |
| EXAMPLE6 | 1 | 1.5 | 2.3 | MONOCHROME (MIXED) | 4.8 | 120 | 115 | 5 | 95 | 90 | 5 | 118 | ○ | ○ | ○ |
| EXAMPLE7 | 0.6 | 1.2 | 2.4 | MONOCHROME (MIXED) | 4.2 | 110 | 90 | 20 | 115 | 70 | 45 | 120 | ○ | ○ | ○ |
| EXAMPLE8 | 0.8 | 1.5 | 2.6 | MONOCHROME (OVERLAP) | 4.9 | 120 | 100 | 20 | 110 | 80 | 30 | 121 | ○ | ○ | ○ |
| EXAMPLE9 | 0.3 | 0.5 | 1 | MONOCHROME (OVERLAP) | 1.8 | 110 | 105 | 5 | 115 | 70 | 45 | 118 | ○ | ○ | ○ |
| EXAMPLE10 | 0.4 | 0.6 | 1.2 | MONOCHROME (OVERLAP) | 2.2 | 130 | 100 | 30 | 100 | 70 | 30 | 125 | ○ | ◎ | ○ |
| COMPARATIVE EXAMPLE1 | 0 | 0 | 5 | MONOCHROME (MIXED) | 5 | 100 | 100 | 0 | 100 | 90 | 10 | 110 | × | × | ○ |
| COMPARATIVE EXAMPLE2 | 0 | 5 | 0 | MONOCHROME (MIXED) | 5 | 120 | 155 | -35 | 85 | 90 | -5 | 127 | × | × | × |
| COMPARATIVE EXAMPLE3 | 5 | 0 | 0 | MONOCHROME (MIXED) | 5 | 135 | 85 | 50 | 85 | 70 | 15 | 135 | × | ○ | × |
| COMPARATIVE EXAMPLE4 | 3 | 1 | 1 | MONOCHROME (OVERLAP) | 5 | 110 | 125 | -15 | 80 | 70 | 10 | 123 | ○ | × | ○ |
| COMPARATIVE EXAMPLE5 | 0.4 | 1.1 | 2.3 | MONOCHROME (OVERLAP) | 3.8 | 110 | 110 | 0 | 80 | 70 | 10 | 120 | × | × | ○ |

FIG.2

IMAGE FORMING APPARATUS, TONER CARTRIDGE SET, TONER IMAGE, AND IMAGE FORMING METHOD

CROSS-REFERENCE TO RELATED APPLICATIONS

This application is a continuation of U.S. patent application Ser. No. 16/216,729, filed on Dec. 11, 2018, which is a division of U.S. patent application Ser. No. 15/889,652, filed on Feb. 6, 2018, the entire contents of each of which are incorporated herein by reference.

FIELD

Embodiments described herein relate generally to an image forming apparatus, a toner cartridge set, a toner image, and an image forming method.

BACKGROUND

A toner that fluoresces in a visible light range when irradiated with ultraviolet rays, such as black light, is often used in applications such as document security. In general, high fluorescence visibility when irradiated with the black light is desirable in these applications.

Generally, commercially available paper contains brightening agents which are fluorescent. Such paper tends to emit blue fluorescence when irradiated with the black light. Thus, visibility of an image formed with fluorescing toner on such paper may be low when irradiated with the black light. Therefore, a toner that glows white with fluorescence under black light conditions would be useful to improve visibility of the toner image.

In applications, such as document security, a toner emitting white fluorescence under black light conditions is often used together with a toner that appears colored under visible light conditions. In this case, an image formed by the visible light toner and an image formed by the fluorescing toner must be arranged on the same paper surface. Therefore, the image formed only with the fluorescing toner is preferably not visible under visible light conditions. In other words, it is preferable for the fluorescing toner to be invisible under normal lighting conditions yet to glow brightly due to fluorescence under other lighting condition.

DESCRIPTION OF THE DRAWINGS

FIG. 2 is a diagram illustrating measurement results and evaluation results according to examples.

DETAILED DESCRIPTION

Figure 1:
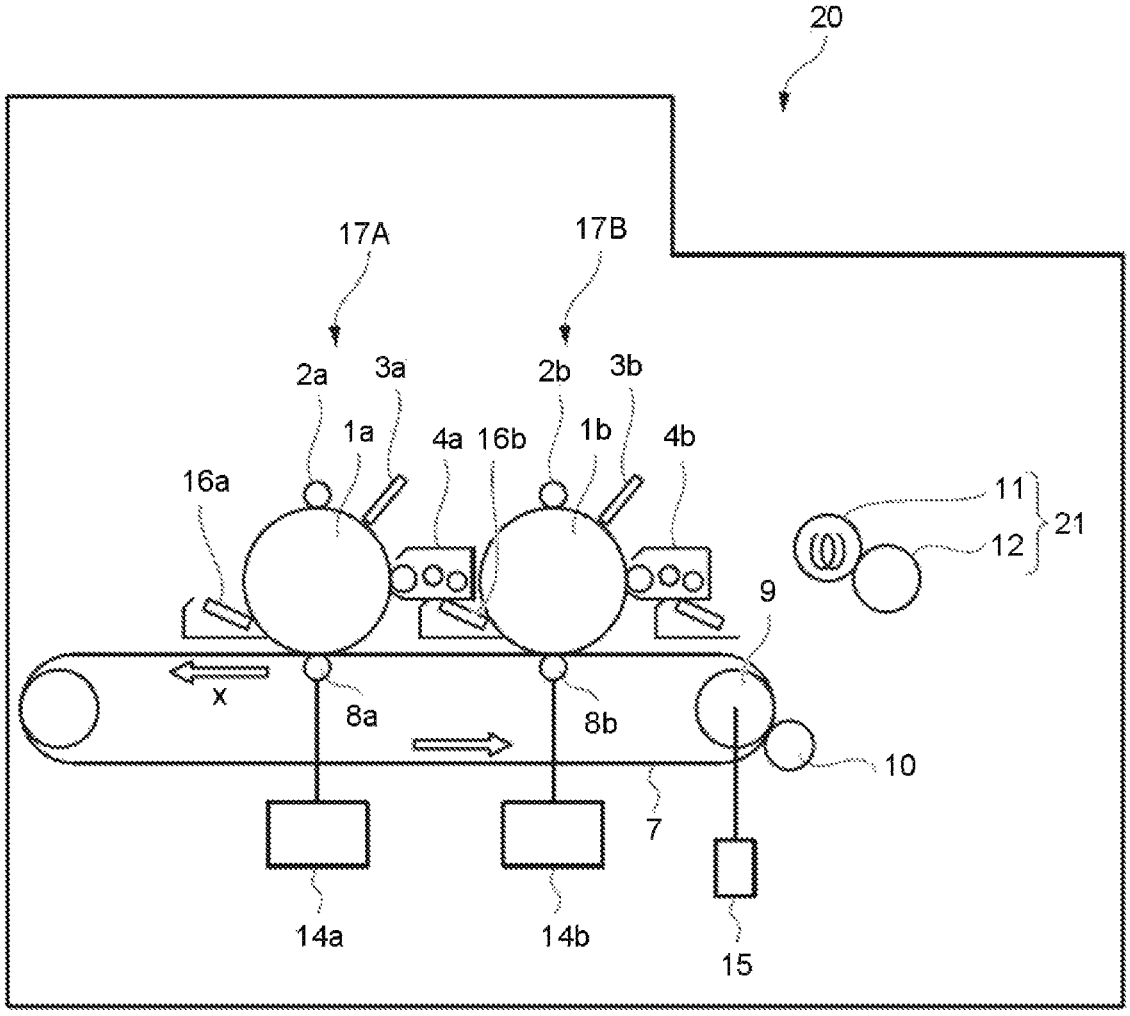
FIG. 1 is a diagram illustrating an image forming apparatus.

In accordance with one embodiment, an image forming apparatus comprises a first image forming unit and a second image forming unit. The first image forming unit is configured to use a first toner to form a first image. The first toner includes at least two kinds of fluorochromes which have a fluorescence peak in a wavelength range different from one another. The second image forming unit is configured to use a second toner to form a second image. The second toner contains visibly colored pigment (a pigment which is visible to human eyes under normal lighting conditions). A softening point temperature of the first toner, as measured by a differential scanning calorimeter, is higher than a softening point temperature of the second toner, as measured by the differential scanning calorimeter.

Hereinafter, an image forming apparatus of an example embodiment is described with reference to the drawings.

FIG. 1 is a diagram illustrating an example of a schematic structure of the image forming apparatus according to an embodiment.

An image forming apparatus 20 has an apparatus main body including an intermediate transfer belt 7, a first image forming unit 17A and a second image forming unit 17B, which are disposed along the intermediate transfer belt 7, and a fixing device 21 arranged downstream of the image forming units. Along a travel direction X of the intermediate transfer belt, (a belt-traveling direction during an image forming process), the first image forming unit 17A is provided downstream of the second image forming unit 17B. The first image forming unit 17A has a photoconductive drum 1*a*, a cleaning device 16*a*, a charging device 2*a*, an exposure device 3*a*, a first developing device 4*a*, and a primary transfer roller 8*a*. The cleaning device 16*a*, the charging device 2*a*, the exposure device 3*a*, and the first developing device 4*a* are arranged in this order along a rotation direction of the photoconductive drum 1*a*. The primary transfer roller 8*a* is arranged relative to the photoconductive drum 1*a* so as to face the photoconductive drum 1*a* across the intermediate transfer belt 7. A primary transfer power source 14*a* is connected to the primary transfer roller 8*a*.

In the first developing device 4*a*, a first toner is accommodated. The first toner may be supplied from a toner cartridge (not shown).

At the downstream side of the first image forming unit 17A, a secondary transfer roller 9 and a backup roller 10 are arranged to face each other across the intermediate transfer belt 7. A secondary transfer power source 15 is connected to the secondary transfer roller 9. The second image forming unit 17B has a photoconductive drum 1*b*, a cleaning device 16*b*, a charging device 2*b*, an exposure device 3*b*, a second developing device 4*b*, and a primary transfer roller 8*b*. The cleaning device 16*b*, the charging device 2*b*, the exposure device 3*b* and the second developing device 4*b* are arranged in this order along a rotation direction of the photoconductive drum 1*b*. The primary transfer roller 8*b* is arranged relative to the photoconductive drum 1*b* so as to face the photoconductive drum 1*b* across the intermediate transfer belt 7. A primary transfer power source 14*b* is connected to the primary transfer roller 8*b*.

In the second developing device 4*b*, a second toner is accommodated. The second toner may be supplied from a toner cartridge (not shown). The fixing device 21 fixes a toner to an image receiving medium, such as paper. The fixing device 21 is arranged at the downstream side of the first image forming unit 17A. The fixing device 21 has a heat roller 11 and a pressure roller 12 arranged to face each other.

In the image forming apparatus 20, the first image forming unit 17A forms a first image using the first toner. Similarly, the second image forming unit 17B forms a second image using the second toner.

The first toner of an embodiment includes at least two kinds of fluorochromes (fluorescent substances or compounds, also referred to as fluorophores). In this context, a "fluorochrome" refers to a pigment which emits fluorescence having a peak in a specific wavelength range upon irradiation with ultraviolet rays, such as black light. Here, "fluorescence peak" is a convex portion of a fluorescence spectrum of light emitted by the fluorochrome upon irradiation with ultraviolet light.

A first fluorochrome of an embodiment has a fluorescence peak in a wavelength range equal to or greater than 400 nm and less than 500 nm (hereinafter, also referred to as a "first wavelength range"). The first fluorochrome may have only one fluorescence peak in the first wavelength range or may have two or more fluorescence peaks in the first wavelength range.

The fluorescence peak of the first fluorochrome may be a clear peak (e.g., discrete line in the emission spectrum) or a band of wavelengths in the emission spectrum. The fluorescence peak can be measured by a spectrophotofluorometer "RF-6000" (manufactured by Shimadzu Corporation) or the like.

The first fluorochrome glows blue if excited with an ultraviolet ray having a wavelength equal to or greater than 350 nm and less than 380 nm.

The first fluorochrome is not particularly limited in composition as long as it has the fluorescence peak in the first wavelength range. For example, the first fluorochrome may be a synthesized product or a commercially available product. As the first fluorochrome, thiophene type fluorochromes, coumarin type fluorochromes, bisstyrylbenzene type fluorochromes and oxazole type fluorochromes and the like are provided as examples. As a commercially available product for the first fluorochrome, "TINOPAL® OB" (manufactured by BASF Co., Ltd.) is provided as an example.

A second fluorochrome of an embodiment has a fluorescence peak in a wavelength range equal to or greater than 500 nm and less than 600 nm (hereinafter, also referred to as a "second wavelength range"). The second fluorochrome may have only one fluorescence peak or may have two or more fluorescence peaks in the second wavelength range.

The fluorescence peak of the second fluorochrome may be a discrete peak (line spectrum) or a wavelength band spectrum. The fluorescence peak can be measured using the spectrophotofluorometer "RF-6000" (manufactured by Shimadzu Corporation) or the like.

The second fluorochrome glows green if excited with ultraviolet rays having a wavelength equal to or greater than 350 nm and less than 380 nm.

The second fluorochrome is not particularly limited in composition so long as it has a fluorescence peak in the second wavelength range. For example, the second fluorochrome may be a synthesized product or a commercially available product. As an example of the second fluorochrome, thiophene type fluorochrome, β-quinophthalone type fluorochrome, coumarin type fluorochrome, bisstyrylbenzene type fluorochrome, and oxazole type fluorochrome and the like are provided as examples. As a possible commercially available product available for the second fluorochrome, "CARTAX® CXDP POWDER" (manufactured by Clariant Co., Ltd.) is provided. A third fluorochrome of an embodiment has a fluorescence peak in a wavelength range equal to or greater than 600 nm and less than 650 nm (hereinafter, also referred to as a "third wavelength range"). The third fluorochrome may have only one fluorescence peak or may have two or more fluorescence peaks in the third wavelength range.

The fluorescence peak of the third fluorochrome may be a discrete peak (line spectrum) or a wavelength band. The fluorescence peak can be measured using the spectrophotofluorometer "RF-6000" (manufactured by Shimadzu Corporation) or the like.

The third fluorochrome glows red if excited with ultraviolet rays with a wavelength equal to or greater than 350 nm and less than 380 nm.

The third fluorochrome is not particularly limited in composition so long as it has a fluorescence peak in the third wavelength range. For example, the third fluorochrome may be a synthesized product or a commercially available product. As a third fluorochrome, β-quinophthalone type fluorochrome and europium complex type fluorochrome are possible examples. As a possible commercial product to be used as the third fluorochrome, "Lumilight Nano R-Y 202" (manufactured by Shinroig Co., Ltd.) is provided.

The first toner preferably has fluorescence peaks in at least two wavelength ranges from among the above described first wavelength range, the second wavelength range, and the third wavelength range. For the fluorescence peaks of the first toner, a distance between the maximum peaks within each wavelength range is preferably at least 50 nm or more, more preferably at least 65 nm or more, and still more preferably at least 80 nm or more.

If the distance between the maximum peaks within each wavelength range is 50 nm or more, the first toner tends to glow in a color other than blue when irradiated with ultraviolet. Therefore, if the distance between the maximum peaks in each wavelength range is 50 nm or more, the first toner tends to have better visibility under ultraviolet light.

The maximum fluorescence peak within each wavelength range means a peak with the maximum intensity within the relevant wavelength range in which the first toner has a fluorescence peak. For example, a case in which the first toner has a fluorescence peak in the first wavelength range and another in the second wavelength range a distance between the fluorescence peak in the first wavelength range and the fluorescence peak in the second wavelength range is 50 nm or more.

A softening point $T_{m1}$ of the first toner is not particularly limited. However, the softening point $T_{m1}$ is preferably 105 to 130 degrees centigrade (° C.), more preferably 110 to 125 degrees centigrade (° C.), still more preferably 112 to 122 degrees centigrade (° C.). If the softening point $T_{m1}$ is equal to or greater than the lower limit value, the image forming apparatus can relatively easily form the first image in which is substantially invisible under normal, visible light. If the softening point $T_{m1}$ is equal to or less than the upper limit value, the image forming apparatus the required fixing property of the toner can be achieved. The softening point $T_{m1}$ is measured by a flow tester.

The first toner preferably satisfies the following formula (10).

$$0.1 \text{ mass } \% \leq a+b+c \leq 45 \text{ mass } \% \quad (10)$$

where a in formula (10) is a content (mass %) of the first fluorochrome with respect to 100 mass % of the first toner, b in formula (10) is a content (mass %) of the second fluorochrome with respect to 100 mass % of the first toner, and c in formula (10) is a content (mass %) of the third fluorochrome with respect to 100 mass % of the first toner.

The mass % sum (a+b+c) is preferably between 0.1 to 45 mass %, more preferably between 0.5 to 30 mass %, still more preferably between 2 to 20 mass %. If mass % sum (a+b+c) is equal to or smaller than the upper limit value, dispersibility and the fixing property of the fluorochrome in the first toner tends to be excellent. If the mass % sum (a+b+c) is in the above stated range, the image forming apparatus can, in general, easily form the first image to have excellent visibility when irradiated with ultraviolet rays. If mass % sum (a+b+c) is in the above stated range, the softening point $T_{m1}$ can be controlled to be a desired value.

The "a" value is preferably 0.01 to 35 mass %, more preferably 0.05 to 23 mass %, and still more preferably 0.1 to 15 mass %.

The "b" value is preferably 0 to 21 mass %, more preferably 0.1 to 14 mass %, and still more preferably 0.5 to 8 mass %.

The "c" value is preferably 0 to 21 mass %, more preferably 0.1 to 14 mass %, and still more preferably 0.5 to 8 mass %.

If a, b and c values are in the stated preferable ranges, the first toner tends to be excellent in the dispersibility, and the visibility of the first toner when irradiated with the ultraviolet ray is good. If a, b and c values are in the stated preferable ranges, it is relatively easy to control the softening point $T_{m1}$ to be a desired value.

The first toner preferably includes at least some first fluorochrome.

If the first toner includes the first fluorochrome, the emission intensity due to irradiation with the ultraviolet ray generally rises. Therefore, if the first toner includes the first fluorochrome, the first image will generally have excellent visibility when irradiated with the ultraviolet rays.

If the first toner includes the first fluorochrome, the first toner preferably satisfies one of the following formulas (1) and (2).

$$a<b \quad (1)$$

$$a<c \quad (2)$$

where "a" in formula (1) and (2) is the content (mass %) of the first fluorochrome with respect to 100 mass % of the first, "b" in formula (1) is the content (mass %) of the second fluorochrome with respect to 100 mass % of the first toner, and "c" in formula (2) is a content (mass %) of the third fluorochrome with respect to 100 mass % of the first toner.

If the first toner includes the first fluorochrome and satisfies either one of the above formulas (1) and (2), t the first image generally has excellent visibility when irradiated with the ultraviolet rays.

If the first toner includes the first fluorochrome, the first toner preferably satisfies the following formula (11).

$$0.05 \leq a/(b+c) \leq 3.0 \quad (11)$$

where "a" in formula (11) is the content (mass %) of the first fluorochrome with respect to 100 mass % of the first toner, "b" in formula (11) is the content (mass %) of the second fluorochrome with respect to 100 mass % of the first toner, and "c" in formula (11) is the content (mass %) of the third fluorochrome with respect to 100 mass % of the first toner.

The above a/(b+c) value of formula 11 is preferably 0.05 to 3.0, more preferably 0.1 to 1.5, and still more preferably 0.2 to 1.0. If the a/(b+c) value is equal to or smaller than the upper limit value, the first toner tends to glows in a color other than the blue when irradiated with the ultraviolet rays. Therefore, if a/(b+c) is equal to or smaller than the upper limit value, the first image has excellent visibility when irradiated with the ultraviolet rays. If the a/(b+c) value is equal to or greater than the lower limit value, the emission intensity of the first toner due to irradiation with the ultraviolet is generally sufficient. Therefore, if the a/(b+c) value is equal to or greater than the lower limit value, the first image formed of the first tone will have good visibility when irradiated with ultraviolet rays.

The first toner preferably includes the first fluorochrome, the second fluorochrome, and the third fluorochrome.

If the first toner includes the first fluorochrome, the second fluorochrome, and the third fluorochrome, the first toner appears to glow white when irradiated with the ultraviolet rays. Thus, if the first toner includes the first fluorochrome, the second fluorochrome, and the third fluorochrome, the first image will have excellent in visibility when irradiated with the ultraviolet rays. The term "white" as used herein refers to a color of a light emission that would typically be perceived as white by human eyes.

If the first toner includes the first fluorochrome, the second fluorochrome, and the third fluorochrome, the first toner should satisfy both the formulas (1) and (2).

$$a<b \quad (1)$$

$$a<c \quad (2)$$

When the first toner includes the first fluorochrome, the second fluorochrome and the third fluorochrome, and satisfies the formula (1) and the formula (2), the first image will have excellent visibility when irradiated with ultraviolet rays.

If the first toner includes the first fluorochrome, the second fluorochrome and the third fluorochrome, the first toner preferably satisfies the following formula (3).

$$a<b<c \quad (3)$$

where "a" in formula (3) is the content (mass %) of the first fluorochrome with respect to 100 mass % of the first toner, "b" in formula (3) is the content (mass %) of the second fluorochrome with respect to 100 mass % of the first toner, and "c" in formula (3) is the content (mass %) of the third fluorochrome with respect to 100 mass % of the first toner.

If the first toner includes the first fluorochrome, the second fluorochrome and the third fluorochrome, and satisfies formula (3), the first toner tends to be excellent in visibility when irradiated with the ultraviolet ray. Therefore, if the first toner includes the first fluorochrome, the second fluorochrome and the third fluorochrome, and satisfies formula (3), the image forming apparatus is easy to form the first image excellent in the visibility when irradiated with the ultraviolet ray.

A preferred embodiment of the first toner satisfies the following formulas (3), (12) and (13).

$$a<b<c \quad (3)$$

$$0.1 \leq a+b+c \leq 45 \quad (12)$$

$$0.05 \leq a/(b+c) \leq 3.0 \quad (13)$$

A more preferable embodiment of the first toner satisfies the following formulas (3), (14) and (15).

$$a<b<c \quad (3)$$

$$0.5 \leq a+b+c \leq 30 \quad (14)$$

$$0.1 \leq a/(b+c) \leq 1.5 \quad (15)$$

A particularly preferred embodiment of the first toner satisfies the following formulas (3), (16) and (17).

$$a<b<c \quad (3)$$

$$2 \leq a+b+c \leq 20 \quad (16)$$

$$0.2 \leq a/(b+c) \leq 1.0 \quad (17)$$

The first toner may include a binder resin.

The binder resin is not particularly limited in composition as long as it can be used as a binder resin of a toner. As specific examples of the binder resin, polyester resin, styrene resin, ethylene resin, acrylic resin, phenol resin, epoxy resin, allyl phthalate resin, polyamide resin, maleic acid resin and the like are presented. As the binder resin, any one of the above examples may be used alone, or two or more may be used in combination. From among the above listed examples, the binder resin is preferably polyester resin from the viewpoint of the fixing property.

As the polyester resin, crystalline polyester resin and non-crystalline polyester resin are possible. From the viewpoint of low temperature fixing property, the binder resin preferably contains the crystalline polyester resin. In the embodiment, polyester resin having a ratio of the softening point to a melting temperature (the softening point/melting temperature) is 0.8 to 1.2 is set as the crystalline polyester resin, and other ones are set as the non-crystalline polyester resin.

The crystalline polyester resin is described.

As the crystalline polyester resin, those obtained by condensation polymerization of divalent or higher alcohol and a divalent or higher carboxylic acid are exemplified.

As the divalent or higher alcohol, ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, trimethylolpropane and the like are exemplified. In these examples, 1,4-butanediol and 1,6-hexanediol are preferable.

As the divalent or higher carboxylic acid, adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, succinic acid substituted with an alkyl group or an alkenyl group, cyclohexane dicarboxylic acid, trimellitic acid, pyromellitic acid, and acid anhydrides thereof or esters thereof are exemplified. As the succinic acid substituted with the alkyl group or the alkenyl group, succinic acid substituted with the alkyl group or alkenyl group having 2 to 20 carbon atoms is exemplified. More specifically, n-dodecenylsuccinic acid, n-dodecylsuccinic acid and the like are exemplified. Fumaric acid is preferable among these.

An endothermic peak temperature $T_{mp1}$ of the crystalline polyester resin is not particularly limited. However, the endothermic peak temperature $T_{mp1}$ is preferably 80 to 115° C., more preferably 82 to 110° C., and still more preferably 84 to 105° C. If the endothermic peak temperature $T_{mp1}$ is equal to or greater than the lower limit value, the first toner tends to be excellent in storability. If the endothermic peak temperature $T_{mp1}$ is equal to or smaller than the upper limit value, the first toner tends to be excellent in the fixing property. The endothermic peak temperature $T_{mp1}$ is measured by the differential scanning calorimeter (DSC).

The content of the crystalline polyester resin is not particularly limited. However, the content of the crystalline polyester resin is preferably 3 to 32 mass %, more preferably 5 to 20 mass %, and still more preferably 7 to 15 mass % with respect to 100 mass % of the first toner. If the content of the crystalline polyester resin is in the preferable range, the softening point $T_{m1}$ can be easily controlled to be a desired value.

If the content of the crystalline polyester resin is 3 mass % or more with respect to 100 mass % of the first toner, low temperature offset resistance is easily improved. If the content of the crystalline polyester resin is 32 mass % or less with respect to 100 mass % of the first toner, the storability under a high temperature environment is easily improved.

The non-crystalline polyester resin is described.

As the non-crystalline polyester resin, those obtained by condensation polymerization of divalent or higher alcohol and divalent or higher carboxylic acid are exemplified. As the divalent or higher carboxylic acid, divalent or higher carboxylic acid, and acid anhydride thereof or ester thereof are presented as examples. As the ester, a lower alkyl (having 1 to 20 carbon atoms) ester of the divalent or higher carboxylic acid is presented as an example.

As the divalent alcohol, alkylene oxide adduct of bisphenol A is preferable. As trihydric or higher alcohol, sorbitol, 1,4-sorbitan, pentaerythritol, glycerol and trimethylolpropane are preferable. As the divalent carboxylic acid, maleic acid, fumaric acid, terephthalic acid, and succinic acid substituted with the alkenyl group having 2 to 20 carbon atoms are preferable. As trivalent or higher carboxylic acid, 1,2,4-benzenetricarboxylic acid (trimellitic acid), and acid anhydride thereof or a lower alkyl (having 1 to 12 carbon atoms) ester thereof are preferable. Any one of divalent or higher alcohol and divalent or higher carboxylic acid may be used alone, or two or more may be used in combination.

In the condensation polymerization of the divalent or higher alcohol and the divalent or higher carboxylic acid, a catalyst which accelerates the reaction may be used. As the catalyst, dibutyltin oxide, titanium compound, dialkoxytin (II), tin oxide (II), aliphatic acid tin (II), dioctanoate tin (II), distearate tin (II) and the like are exemplified.

As a method of obtaining the binder resin, a method of polymerizing a vinyl polymerizable monomer and derivatives of the vinyl polymerizable monomer singly or in plural kinds is exemplified.

As the vinyl polymerizable monomer, aromatic vinyl monomers such as styrene, methyl styrene, methoxystyrene, phenylstyrene, chlorostyrene and the like; ester monomers such as methyl acrylate, ethyl acrylate, butyl acrylate, methyl methacrylate, ethyl methacrylate, butyl methacrylate and the like; carboxylic acid-containing monomers such as acrylic acid, methacrylic acid, fumaric acid, maleic acid and the like; amine monomers such as aminoacrylate, acrylamide, methacrylamide, vinylpyridine, vinylpyrrolidone and the like are exemplified.

At the time of polymerization of the binder resin, auxiliary components such as a chain transfer agent, a crosslinking agent, a polymerization initiator, a surfactant, a coagulant, a pH adjuster, a defoaming agent and the like may be used. The auxiliary component is not particularly limited as long as it can be used to obtain the binder resin. The binder resin can also be obtained by polycondensation of a polycondensation polymerizable monomer composed of an alcohol component and a carboxylic acid component.

The first toner may contain an additive.

The additive is not particularly limited in composition so long as it is useful as an additive in a toner. Specific examples of additives include a charge control agent, a release agent, a surfactant, a basic compound, a coagulant, a pH adjuster, an antioxidant, and the like. The first toner preferably contains a release agent.

From the viewpoint of the storability, ester wax is preferable as the releasing agent.

The endothermic peak temperature $T_{mp2}$ of the ester wax is not particularly limited. However, the endothermic peak temperature $T_{mp2}$ is preferably 60 to 75° C., more preferably 62 to 73° C., and still more preferably 63 to 72° C. If the endothermic peak temperature $T_{mp2}$ is equal to or smaller than the upper limit value, the fixing property of the first toner tends to be excellent. The endothermic peak temperature $T_{mp2}$ is measured by the differential scanning calorimeter.

The ester wax content is not particularly limited. However, the ester wax content is preferably 3 to 13 mass %, more preferably 5 to 12 mass %, and still more preferably 6 to 11 mass % with respect to 100 mass % of the first toner. If the ester wax content is 3 mass % or more of the mass of the whole of the toner particles, low temperature offset resistance and high temperature offset resistance are improved. If the ester wax content is 13 mass % or less of the mass of the whole of the toner particles, toner scattering, toner adhesion to the photoconductor, and stability in a high temperature environment are improved.

For example, the ester wax can be synthesized from a long chain alkyl carboxylic acid and a long chain alkyl alcohol by an esterification reaction. As the long chain alkyl carboxylic acid, palmitic acid, stearic acid, arachidic acid, behenic acid, lignoceric acid, cerotic acid, montanic acid and the like are exemplified. As a long chain alkyl alcohol, palmityl alcohol, stearyl alcohol, arachidyl alcohol, behenyl alcohol, lignoceryl alcohol, ceryl alcohol, montanyl alcohol and the like are presented as examples.

The first toner includes the crystalline polyester resin and the ester wax, and the endothermic peak temperature $T_{mp1}$ is preferably higher than the endothermic peak temperature $T_{mp2}$. If the endothermic peak temperature $T_{mp1}$ is higher than the endothermic peak temperature $T_{mp2}$, the low temperature fixing property of the first toner tends to be excellent.

If the endothermic peak temperature $T_{mp1}$ is higher than the endothermic peak temperature $T_{mp2}$, a temperature difference between the endothermic peak temperature $T_{mp1}$ and the endothermic peak temperature $T_{mp2}$ is preferably 15° C. or less, more preferably 10° C. or less, and still more preferably 5° C. or less. If the temperature difference is 15° C. or less, the first toner tends to be excellent in the low temperature fixing property.

It is preferable that the first toner does not contain a colored pigment. If the first toner does not contain a visible colored pigment, the visibility of an image formed by the first toner tends to be low under normal lighting conditions. Thus, if the first toner does not contain the pigment colored in the visible light, a first image that is substantially invisible under visible light can be produced.

A method of manufacturing the first toner is described. The first toner can be manufactured, for example, by a kneading and pulverizing method or a chemical method.

As the kneading and pulverizing method, for example, a manufacture method including: a mixing step of mixing at least two kinds of fluorochromes, selected from the group composed of the first to the third fluorochromes, with a binder resin; a kneading step of melting and kneading the mixture to obtain a kneaded material; and a pulverizing step of pulverizing the kneaded material to obtain a pulverized material. The above manufacturing method may further include a classification step of sorting the pulverized material according to size or size range so as to obtain particles of predetermined size or of a particular distribution of sizes.

In the mixing step, the raw materials of the first toner are mixed. A mixer used in the mixing step is not particularly limited so long as it can mix the raw materials of the first toner.

In the kneading step, the mixture formed in the mixing step is melt processed and kneaded to form the kneaded material. A kneader apparatus used in the kneading step is not particularly limited so long as it can perform melting and kneading.

In the pulverizing step, the kneaded material is pulverized to form the pulverized material. A pulverizer used in the pulverizing step is not particularly limited so long as it can pulverize the kneaded material. As the pulverizer, a hammer mill can be used, for example. The pulverized material obtained by the pulverizer may then be finely pulverized. The pulverizer for finely pulverizing the pulverized material is not particularly limited as long as it can further pulverize the pulverized material. The pulverized material obtained in the pulverizing step may be used as the first toner or may be first subjected to a classification step before being used as the first toner.

In the classification step, the pulverized material obtained in the pulverizing step is sorted or otherwise separated by particle size or sizes. A classifier apparatus used in the classification step is not particularly limited as long as it can classify the pulverized material according to particle size.

A chemical method is described.

In the chemical method for providing the first toner, at least two kinds of fluorochromes, selected from the group composed of the first to the third fluorochromes, and a binder resin are mixed. The mixture is then melt processed and kneaded. The kneaded material is then pulverized to form medium grinding particles, which are coarsely granulated. The medium grinding particles are then mixed with an aqueous medium to prepare a mixed solution. The mixed solution is subjected to mechanical shearing to form a fine particle dispersion. Finally, the fine particles agglomerate in the fine particle dispersion to form the first toner.

The material manufactured as described above may be used as the first toner as it is or this material may be mixed with an external additive as required before use as the first toner.

An external additive is described.

The external additive can be added to improve the fluidity, chargeability, and stability during storage of the first toner. As the external additive, particles formed by an inorganic oxide are provided as an example. As the inorganic oxide, silica, titania (titanium dioxide), alumina, strontium titanate, tin oxide and the like are exemplified. The particles formed by the inorganic oxide may be subjected to surface treatment with a hydrophobizing agent to improve the stability during storage.

A volume average particle diameter of a particle group including the particles formed by the inorganic oxide is not particularly limited. However, the volume average particle diameter is preferably in a range of 8 to 200 nm. If the volume average particle diameter of the particle group is less than the lower limit value, a transfer efficiency of the first toner onto a transfer belt or a paper may deteriorate. If the volume average particle diameter of the particle group exceeds the upper limit value, there is a possibility that the photoconductor will be damaged.

Any various external additives may be used alone or in combination.

The amount of the external additive is not particularly limited. However, the amount of the external additive is preferably in a range of 0.2 to 8.0 mass % of the total mass of the first toner. In the first toner, in addition to the particles formed by an inorganic oxide, fine resin particles of 1 μm or less may be further added.

A method of adding the external additive is described.

The external additive is mixed with the first toner by a mixer, for example. As the mixer in this process, the same mixer as used in the toner manufacturing method may be used.

The coarse particles of the external additive may be filtered by a sieve device, if necessary. The sieve device is not particularly limited as long as the coarse particles can be retained.

The first toner can be used in one component developer or in a two component developer when combined with a carrier.

The first toner as described above can be used for forming the first image using the first image forming unit 17A of the image forming apparatus 20. The first toner is not limited to being applied to the first image forming unit 17A.

The second toner is described.

The second toner contains a colored pigment visible under normal (visible) light conditions. The colored pigment is not particularly limited as long as the color can be perceived by the human eyes. As the colored pigment, colored pigments in one of the four colors often used in color printing (yellow (Y), magenta (M), cyan (C) and black (K)) can be used. The colored pigment may be a colorant or a coloring agent.

The softening point $T_{m2}$ of the second toner is not particularly limited. However, the softening point $T_{m2}$ is preferably 90 to 120° C., more preferably 95 to 115° C., and still more preferably 97 to 110° C. If the softening point $T_{m2}$ is equal to or greater than the lower limit value, the image forming apparatus can form the second image to appear substantially invisible in the visible light. If the softening point $T_{m2}$ is equal to or less than the upper limit value, the image forming apparatus can form the second image to appear substantially invisible in the visible light. The softening point $T_{m2}$ is measured with a flow tester.

The second toner may include the above-mentioned binder resin or additives.

A method of manufacturing the second toner is described. The second toner can be manufactured, for example, by a kneading and pulverizing method or a chemical method.

As the kneading and pulverizing method, for example, a manufacturing method including: a mixing step of mixing a colored pigment and a binder resin; a kneading step of melt processing and kneading the mixture to obtain a kneaded material; and a pulverizing step of pulverizing the kneaded material to obtain a pulverized material can be used. The above manufacturing method may further include a step of classifying or sorting the pulverized material by size as necessary.

In the mixing step, the raw materials of the second toner are mixed to form a mixture. The mixer used in the mixing step is not particularly limited as long as it can mix the raw material of the second toner.

In the kneading step, the mixture formed in the mixing step is melt and kneaded to form a kneaded material. The kneader used in the kneading step is not particularly limited as long as it can melt and knead the mixture.

In the pulverizing step, the kneaded material formed in the kneading step is pulverized to form a pulverized material. The pulverizer used in the pulverizing step is not particularly limited as long as it can pulverize the kneaded material. As the pulverizer, a hammer mill is exemplified. The pulverized material obtained by the pulverizer may be further finely pulverized. The pulverizer for finely pulverizing the pulverized material is not particularly limited as long as it can further pulverize the pulverized material. The pulverized material obtained in the pulverizing step may be used as the second toner as it is, or may be classified as the second toner by executing a classification step as necessary.

In the classification step, the pulverized material obtained in the pulverizing step is classified by particle size or size range. The classifier used in the classification step is not particularly limited as long as it can classify the particles of the pulverized material by size or size range.

A chemical method is described.

In the chemical method, a colored pigment and a binder resin are mixed to form a mixture. The mixture is then melted and kneaded to form a kneaded material. The kneaded material is then pulverized to form medium grinding particles which are coarsely granulated. The medium grinding particles are mixed with an aqueous medium to prepare a mixed solution. The mixed solution is subjected to mechanical shearing to form a fine particle dispersion. Finally, the fine particles are agglomerated in the fine particle dispersion to form the second toner.

The second toner manufactured as described above may be used as the second toner as it is or may be mixed with an external additive before use as the second toner.

The external additive can be added to improve the fluidity, chargeability, and stability during storage of the second toner. As the external additive, particles formed by an inorganic oxide are exemplified. As the inorganic oxide, silica, titania (titanium dioxide), alumina, strontium titanate, tin oxide and the like are exemplified. The particles formed by the inorganic oxide may be subjected to surface treatment with a hydrophobizing agent from the viewpoint of improving the stability during storage.

A volume average particle diameter of a particle group including the particles formed by the inorganic oxide is not particularly limited. However, the volume average particle diameter is preferably in a range of 8 to 200 nm. If the volume average particle diameter of the particle group including the particles is less than the lower limit value, a transfer efficiency of the second toner onto the transfer belt or the paper may deteriorate. If the volume average particle diameter of the particle group including the particles exceeds the upper limit value, there is a possibility that the photoconductor is damaged.

Various external additives may be used alone or in combination.

An amount of the external additive is not particularly limited. However, the amount of the external additive is preferably in a range of 0.2 to 8.0 mass % of the total mass of the second toner. In the second toner, in addition to the particles formed by the inorganic oxide, fine resin particles of 1 μm or less may be further added.

A method of adding the external additive is described.

The external additive is mixed into the second toner by a mixer, for example. As the mixer, the same mixer as that used in the manufacturing method of the second toner is exemplified.

The coarse particles of the external additive may be filtered by a sieve device, if necessary. The sieve device is not particularly limited as long as the coarse particles can be retained.

The second toner can be used as a one component developer or as a two component developer, in combination with a carrier.

The second toner described above can be used as the toner used for forming the second image with the second image forming unit 17B of the image forming apparatus 20. The second toner is not limited to being applied to the second image forming unit 17B.

In this embodiment, the softening point $T_{m1}$ of the first toner is higher than the softening point $T_{m2}$ of the second toner. If the softening point $T_{m1}$ is higher than the softening point $T_{m2}$, the gloss of the first image formed by the first toner is suppressed to be lower than that of the second image formed by the second toner. By suppressing the gloss of the first image, the image forming apparatus can form the first image to be substantially invisible under visible light conditions.

In this embodiment, the temperature difference between the softening point $T_{m1}$ and the softening point $T_{m2}$ is preferably 5 to 30° C. If the difference between the softening point $T_{m1}$ and the softening point $T_{m2}$ is 5° C. or more, the first image can have excellent visibility when irradiated with the ultraviolet light. If the difference between the softening point $T_{m1}$ and the softening point $T_{m2}$ is 30° C. or less, the first image can be formed to be substantially invisible under visible light.

It is preferable that the image forming apparatus arranges the first image and the second image close to each other. The image forming apparatus arranges the first image and the second image close to each other so that the gloss of the first image can be suppressed to be lower than that of the second image.

A toner cartridge set of an embodiment is described.

The toner cartridge set has a first toner cartridge and a second toner cartridge.

In the first toner cartridge, the first toner is accommodated in a container. The container is not particularly limited as long as it can accommodate the toner. The first toner cartridge can be used as a toner cartridge used in formation of the first image by the first image forming unit 17A. The first toner cartridge is not limited to being applied to the image forming apparatus 20.

In the second toner cartridge, the second toner is accommodated in a container. The container is not particularly limited as long as it can accommodate the toner. The second toner cartridge can be used as a toner cartridge used in formation of the second image by the second image forming unit 17B. The second toner cartridge is not limited to being applied to the image forming apparatus 20.

The image formation is executed by the image forming apparatus 20 as follows, for example.

First, the charging device 2*b* uniformly charges the photoconductive drum 1*b*. The exposure is performed by the exposure device 3*b* to form a second electrostatic latent image. The development is performed with the second toner supplied from the developing device 4*b* to form a second toner image.

Subsequently, the charging device 2*a* uniformly charges the photoconductive drum 1*a*. The exposure device 3*a* performs the exposure (independently of the second toner image formation) to form a first electrostatic latent image. The development is performed with the first toner supplied from the developing device 4*a* to form a first toner image.

The second toner image and the first toner image are transferred onto the intermediate transfer belt 7 in this order by using the primary transfer rollers 8*a* and 8*b*.

The first toner image and the second toner image transferred onto the intermediate transfer belt 7 are then secondarily transferred onto the image receiving medium (not specifically shown) via the secondary transfer roller 9 and the backup roller 10. Then, the first toner is fixed on the image receiving medium to form the first image. The second toner is fixed on the image receiving medium to form the second image.

The image forming apparatus shown in FIG. 1 fixes the toner image, but the image forming apparatus type is not limited thereto. For example, the image forming apparatus may be an inkjet type image forming apparatus.

The first image is obtained by fixing the first toner. The mode of fixing is not particularly limited as long as the first toner can be fixed on the image receiving medium such as the paper. In this description, the image obtained by secondarily transferring the first toner image onto the image receiving medium can be referred to as the first image.

The second image is obtained by fixing the second toner. The mode of fixing is not particularly limited as long as the second toner can be fixed on the image receiving medium, such as the paper. In this description, the image obtained by secondarily transferring the second toner image onto the image receiving medium can be referred to as the second image.

The printed matter has the first image and the second image fixed thereon.

It is preferable that the first image and the second image are close to each other. If the first image and the second image are close to each other, the gloss of the first image can be suppressed to be lower than that of the second image. Therefore, the printed matter has an image not easily visible under visible light.

An image forming method is described.

The image forming method has a first step and a second step.

The first step is a step of forming the first image using the first toner. In this embodiment, the first image can be formed by fixing the first toner on the image receiving medium. By using the image forming apparatus 20, the first toner image can be secondarily transferred onto the image receiving medium to form the first image. The apparatus that performs the first step is not limited to the image forming apparatus 20.

The second step is a step of forming the second image using the second toner. In the embodiment, the second image can be formed by fixing the second toner on the image receiving medium such as the paper. In the embodiment, by using the image forming apparatus 20, the second toner image can be secondarily transferred onto the image receiving medium to form the second image. The apparatus that performs the second step is not limited to the image forming apparatus 20.

In the embodiment, the softening point $T_{m1}$ of the first toner as measured by a differential scanning calorimeter is higher than the softening point $T_{m2}$ of the second toner as measured by a differential scanning calorimeter. If the softening point $T_{m1}$ is higher than the softening point $T_{m2}$, the gloss of the first image is suppressed to be lower than that of the second image. By suppressing the gloss of the first image, the image forming method can form the first image with non-visibility in visible light.

In the embodiment, it is preferable to closely arrange the first image and the second image. If the first image and the second image are close to each other, the gloss of the first image is suppressed to be lower than that of the second image.

The developing by the first toner and the developing by the second toner may be performed together. Thereafter, each toner may be fixed on the image receiving medium, such as paper, to form the first image and the second image on the image receiving medium, respectively.

The developing by one of the first toner or the second toner may be carried out, and this developed toner is fixed on the image receiving medium. Thereafter, the developing by the other one of the first toner or the second toner may be carried out and this other toner is fixed on the image receiving medium to form the first image and the second image on the image receiving medium, respectively.

According to the embodiments described above, even if a commercially available paper (e.g., paper including brightening agents) is printed, an image having excellent visibility when irradiated with ultraviolet while being invisible in visible light can be formed.

Hereinafter, certain examples are described in detail.

The toner cartridge sets in the examples 1 to 10 and comparative examples 1 to 5 are manufactured as follows.

As the first toner in example 1, a toner that glows white with fluorescence upon irradiation with ultraviolet rays is manufactured.

In a Henschel mixer (manufactured by Mitsui Mining Co., Ltd.), the raw materials of the first toner (as detailed below) are added and mixed.

The composition of the raw materials of the first toner is as follows:

the first fluorochrome (TINOPAL OB) 0.9 parts by mass, the second fluorochrome (CARTAX CXDP POWDER) 1.4 parts by mass, the third fluorochrome (Lumilight Nano R-Y 202) 2.7 parts by mass, crystalline polyester resin (endothermic peak temperature $T_{mp1}$: 100° C.) 8.0 parts by mass, charge control agent (inclusion compound of polysaccharide including aluminum and magnesium) 1 part by mass, non-crystalline polyester resin 81 parts by mass, and ester wax (endothermic peak temperature $T_{mp2}$: 70° C.) 5 parts by mass.

The mixture of the raw material of the toner is melted and kneaded by a twin screw extruder. The melted and kneaded material is cooled and then roughly pulverized with a hammer mill. The coarse pulverized material is then finely pulverized with a jet pulverizer. The finely pulverized material is sorted to obtain a powder. The volume average particle diameter of the powder is 7 μm.

100 parts by mass of the powder and the following external additives are input and mixed in a Henschel mixer (manufactured by Mitsui Mining Co., Ltd.) to manufacture the first toner in the example 1.

The composition of the external additive is as follows:

hydrophobic silica A (trade name "RX 50", manufactured by Nippon Aerosil Co., Ltd., average primary particle diameter: 30 nm) 1.0 part by mass, hydrophobic silica B (trade name "VP SX 110", manufactured by Nippon Aerosil Co., Ltd., average primary particle diameter: 100 nm) 0.9 parts by mass, and hydrophobic titanium oxide (trade name "STT-30S", manufactured by Titanium Industry Co., Ltd., average primary particle diameter: 20 nm) 0.5 parts by mass.

As the second toner in example 1, a toner containing a pigment black under visible light is manufactured.

The raw material of the second toner shown below is added and mixed in a Henschel mixer (manufactured by Mitsui Mining Co., Ltd.).

The composition of the raw material of the second toner is as follows:

carbon black (MA-100) 5.0 parts by mass, crystalline polyester resin 5.0 parts by mass, charge control agent (inclusion compound of polysaccharide including aluminum and magnesium) 1 part by mass, non-crystalline polyester resin 84 parts by mass, and ester wax 5 parts by mass.

The mixture of the raw material of the toner is melted and kneaded by the twin screw extruder. The melted and kneaded material is cooled and then roughly pulverized with the hammer mill. The coarse pulverized material is then finely pulverized with the jet pulverizer. The finely pulverized material is sorted to obtain a powder. The volume average particle diameter of the powder is 7 μm.

100 parts by mass of the powder and the following external additives are input and mixed in the Henschel mixer (manufactured by Mitsui Mining Co., Ltd.) to manufacture the second toner in example 1.

The composition of the external additive is as follows:

hydrophobic silica A (trade name "RX 50", manufactured by Nippon Aerosil Co., Ltd., average primary particle diameter: 30 nm) 1.5 part by mass, hydrophobic silica B (trade name "VP SX 110", manufactured by Nippon Aerosil Co., Ltd., average primary particle diameter: 100 nm) 0.9 parts by mass, and hydrophobic titanium oxide (trade name "STT-30S", manufactured by Titanium Industry Co., Ltd., average primary particle diameter: 20 nm) 0.6 parts by mass.

The first toner in examples 2 to 10 and comparative examples 1 to 5 are manufactured in the same manner as in the example 1, excepting that the raw material of the first toner is changed according to the compositions shown in FIG. 2. The second toner in examples 2 to 10 and comparative examples 1 to 5 is manufactured in the same manner as in the example 1, excepting that the raw material of the second toner is changed according to the compositions shown in FIG. 2.

The softening point $T_{m1}$ of the first toner has been measured for the obtained first toner in the examples 1 to 10 and the comparative examples 1 to 5. Similarly, for the second toner in the examples 1 to 10 and the comparative examples 1 to 5, the softening point $T_{m2}$ of the second toner has been measured. "$T_{m1}$" column and "$T_{m2}$" column in FIG. 2 show measurement results of the softening point $T_{m1}$ of the first toner and the softening point $T_{m2}$ of the second toner in the examples 1 to 10 and the comparative examples 1 to 5.

The measurement method of the softening points is described.

The softening point is measured by a flow tester "CFT-500D" (manufactured by Shimadzu Corporation). The measurement conditions are as follows:

sample amount: 1.5 mg rate of temperature increase: 2.5° C./min cylinder load: 20 kg nozzle: 1 mm*1 mm.

measurement method: the softening point is measured as a melting temperature in the 1/2 method. The melting temperature in the 1/2 method is calculated according to the following description. First, the temperature of the sample is raised from 30° C. to a temperature at which the outflow of the sample is completed (around 200° C.). Next, 1/2 of a difference between a descent amount Smax of the piston at the time the outflow is completed and a descent amount Smin of the piston at the time the outflow starts is calculated (this is taken as X, where X=(Smax−Smin)/2). The temperature of a flow curve at the time the descending amount of the piston in the flow curve is the sum of X and Smin is the melting temperature in the 1/2 method.

A method of measuring the endothermic peak temperature is described.

The endothermic peak temperature is measured by DSC "DSC Q 2000" (manufactured by TA Instruments). The measurement conditions are as follows:

sample amount: 5 mg lid and pan: Alumina rate of temperature rise: 10° C./min measurement method: the temperature of the sample is raised from 20° C. to 200° C. Thereafter, the sample is cooled to 20° C. or lower. Then, the sample is heated again and a maximum endothermic peak measured in a temperature range of 55 to 150° C. is set as the endothermic peak temperature.

In the examples 1 to 10 and the comparative examples 1 to 5 6 parts by mass of the first toner and 100 parts by mass of a ferrite carrier (coated with a silicone resin with an average particle diameter of 40 μm on the surface thereof) are stirred with a tumbler mixer to obtain the first developer in each example. The first developer in each example is housed in a toner cartridge to obtain the first toner cartridge in each example. Similarly, in the examples 1 to 10 and the comparative examples 1 6 parts by mass of the second toner to 5 and 100 parts by mass of a ferrite carrier (coated with a silicone resin with an average particle diameter of 40 μm on the surface thereof) are stirred with a tumbler mixer to obtain the second developer in each example. The second developer in each example is housed in a toner cartridge to obtain the second toner cartridge in each example. The toner cartridge sets in the examples 1 to 10 and the comparative examples 1 to 5 are obtained by respectively combining the first toner cartridge in each example and the second toner cartridge in each example.

The toner cartridge set in each example was arranged in a commercially available device, e-studio 5005 (manufactured by TOSHIBA TEC Corporation). With this, a solid image having a toner adhesion amount of about 1.0 mg/cm$^2$ on a paper of 90 g/cm$^2$ made by Mondi and containing a fluorescent brightening agent is obtained. The solid image includes the first image and the second image together.

An "output method" column in FIG. 2 shows the mode used for the image forming method.

In each example described as "monochrome (mixed)", both the developing by the first toner and the developing by the second toner are carried out. Thereafter, each toner is fixed on the paper to form the first image and the second image on the paper at the same time.

In each example described as "monochrome (overlap)", the developing by the second toner is carried out, and the second toner is fixed on the paper. Thereafter, the developing by the first toner is carried out, the first toner is fixed on the paper, and the first image and the second image are formed on the paper sequentially.

A method of evaluating visibility under ultraviolet is described.

For a solid image glowing with fluorescence and clearly recognizable under a black light (wavelength 370 nm), the visibility is evaluated as passing (o). For a solid image which does not glow with fluorescence and clearly recognizable under black light, the visibility is evaluated as failure (x). The column "Visibility when irradiated with the ultraviolet ray" in FIG. 2 shows the evaluation results for the visibility under ultraviolet light for the images formed with the toner cartridge sets in the examples 1 to 10 and the comparative examples 1 to 5.

A method for evaluating visibility under visible light is described.

For a solid image including an image part which is preferably recognizable when irradiated with the black light but not recognizable in just visible light (i.e., without the black light), the visibility of the image part in the example under visible light is evaluated as passing (o) if the image part is substantially invisible in visible light conditions. If the image part of the example is visible under visible light conditions, then this is evaluated as failure (x). Among those in which the visibility is evaluated as passing (o), for those inferred that the image part cannot be recognized particularly in the visible light (without ultraviolet), the visibility in visible light is evaluated as fine (◎). A column "non-visibility in the visible light" in FIG. 2 shows visible light evaluation results for images formed with the toner cartridge sets in the examples 1 to 10 and the comparative examples 1 to 5.

A method of evaluating a low temperature fixing property is described.

The first developer in each example is accommodated in a toner cartridge. The toner cartridge is arranged in the e-studio 5005c device (made by Toshiba Tec). The e-studio 5005c device is obtained by modifying a printer so that a toner fixing temperature can be changed in units of 0.1° C. in a range of 100 to 200° C.

Ten solid images with the fixing temperature set to 150° C., and the toner adhesion amount of 1.5 mg/cm$^2$ are obtained. When no image peeling due to offset or unfixing occurs in any of the ten solid images thus produced, the set temperature is lowered by 1° C. and a solid image is obtained in the same manner as described above. This operation is repeated to determine the lower limit temperature for the fixing temperature at which no image peeling occurs in the solid images, and the lower limit temperature is set as the lowest fixing temperature of toner for which no image peeling occurs. For examples in which the lowest fixing temperature is 125° C. or less, the low temperature fixing property of the first toner is evaluated as passing (o), and for a solid image of which the lowest fixing temperature exceeds 125° C., the low temperature fixing property of the first toner is evaluated as failure (x). A column of "low temperature fixing property" in FIG. 2 shows the evaluation results of the low temperature fixing property of the first toner in the examples 1 to 10 and the comparative examples 1 to 5.

Images formed with the toner cartridge set in the examples 1 to 10 all passed the evaluation of the visibility when irradiated with the ultraviolet ray. Images formed with the toner cartridge set in the examples 1 to 10 are excellent in the visibility when irradiated with ultraviolet.

Images formed with the toner cartridge set in the examples 1 to 10 all passed the evaluation of the visibility under the visible light. That is, images formed with the toner cartridge set in the examples 1 to 10 are substantially invisible in visible light.

All of the toner cartridge sets in the examples 1 to 10 passed the evaluation of the low temperature fixing property. The lowest fixing temperatures of the first toner in the examples 1 to 10 are each 125° C. or less.

In the toner cartridge set in the examples 1 to 10, an image invisible in the visible light is considered to be formed because the softening point $T_{m1}$ of the first toner is higher than the softening point $T_{m2}$ of the second toner.

Since the toner cartridge set in the examples 1 to 10 contains at least two kinds of fluorochromes selected from the group composed of the first fluorochrome, the second fluorochrome, and the third fluorochrome, the image has excellent visibility when irradiated with the ultraviolet ray.

On the other hand, images formed with the toner cartridge sets in the comparative examples do not have properties of both visibility under ultraviolet and substantial invisibility under visible light.

In the image formed with the toner cartridge sets in comparative examples 1, 2, 4 and 5, the softening point $T_{m1}$ of the first toner is equal to or less than the softening point $T_{m2}$ of the second toner, and thus, the first image which is supposed to be visibly recognized only when irradiated with the ultraviolet, is visibly recognizable in the visible light.

In the toner cartridge set in the comparative example 3, an offset image is formed because the softening point $T_{m1}$ of the first toner is higher than the softening point $T_{m2}$ of the second toner by 30° C. or more.

Since the toner cartridge sets in the comparative examples 1 to 3 do not contain at least two different kinds of fluorochromes, images with excellent visibility in ultraviolet are not formed.

While certain embodiments have been described these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a first image forming unit configured to form a first image on a sheet with a first toner, the first toner configured to glow white upon excitation with ultraviolet light and including three fluorochromes, each of the three fluorochromes having a fluorescence peak in a wavelength range different from the others, a first fluorochrome of the three fluorochromes fluorescing in a blue color wavelength range when excited with ultraviolet light, a second fluorochrome of the three fluorochromes fluorescing in a green color wavelength range when excited with ultraviolet light, a third fluorochrome of the three fluorochromes fluorescing in a red color wavelength range when excited with ultraviolet light; and a second image forming unit configured to form a second image on the sheet with a second toner, the second toner including a visible colored pigment, the second image being adjacent but not overlapping with the first image on the sheet.

2. The imagine forming apparatus according to claim 1, wherein the first fluorochrome has a fluorescence peak in a wavelength range between 400 nm and 500 nm, the second fluorochrome has a fluorescence peak in a wavelength range between 500 nm and 600 nm, and the third fluorochrome has a fluorescence peak in a wavelength range between 600 nm and 650 nm upon irradiation with ultraviolet light.

3. The image forming apparatus according to claim 2, wherein a mass % of the first fluorochrome with respect to total mass of the first toner is less than a mass % of the second fluorochrome with respect to total mass % of the first toner.

4. The image forming apparatus according to claim 2, wherein a mass % of the first fluorochrome with respect to total mass of the first toner is less than a mass % of the third fluorochrome with respect to total mass % of the first toner.

5. The image forming apparatus according to claim 2, wherein a mass % of the first fluorochrome with respect to total mass of the first toner is less than a mass % of the second fluorochrome with respect to total mass % of the first toner, and the mass % of the first fluorochrome with respect to total mass of the first toner is less than a mass % of the third fluorochrome with respect to total mass % of the first toner.

6. The image forming apparatus according to claim 2, wherein a mass % of the first fluorochrome with respect to total mass of the first toner is less than a mass % of the second fluorochrome with respect to total mass % of the first toner, and the mass % of the second fluorochrome with respect to total mass of the first toner is less than a mass % of the third fluorochrome with respect to total mass % of the first toner.

7. The image forming apparatus according to claim 1, wherein the first toner and the second toner soften at different temperatures.

8. The image forming apparatus according to claim 1, wherein the first toner further includes a crystalline polyester resin and an ester wax, and an endothermic peak temperature of the crystalline polyester resin, as measured by differential scanning calorimetry, is higher than an endothermic peak temperature of the ester wax, as measured by differential scanning calorimetry.

9. An image forming apparatus, comprising:

a first image forming unit storing a first toner and configured to form a first image on a sheet using the first toner, the first toner including a first fluorochrome fluorescing in a blue color wavelength range when excited with ultraviolet light, a second fluorochrome fluorescing in a green color wavelength range when excited with ultraviolet light, a third fluorochrome fluorescing in a red color wavelength range when excited with ultraviolet light such that the first toner glows a white color when excited with ultraviolet light;

a second image forming unit storing a second toner and configured to form a second image on the sheet with the second toner, the second toner including a visible colored pigment, the second image being adjacent to the first image on the sheet; and a fixing unit configured to fix the first image and the second image to the sheet by heating the sheet.

10. The image forming apparatus according to claim 9, wherein the first image and the second image are fixed to the sheet simultaneously in the fixing unit.

11. The imagine forming apparatus according to claim 9, wherein the first fluorochrome has a fluorescence peak in a wavelength range between 400 nm and 500 nm, the second fluorochrome has a fluorescence peak in a wavelength range between 500 nm and 600 nm, and the third fluorochrome has a fluorescence peak in a wavelength range between 600 nm and 650 nm upon irradiation with ultraviolet light.

12. The image forming apparatus according to claim 9, wherein the first toner and the second toner soften at different temperatures.

13. The image forming apparatus according to claim 9, wherein the first toner further includes a crystalline polyester resin and an ester wax, and an endothermic peak temperature of the crystalline polyester resin, as measured by differential scanning calorimetry, is higher than an endothermic peak temperature of the ester wax, as measured by differential scanning calorimetry.

14. A printer, comprising:

a first image forming unit comprising a first photoconductive drum, a first charging device, and a first exposure unit, the first image forming unit storing a first toner in a first developing device and configured to form a first toner image on the first photoconductive drum with the first toner then transfer the first toner image to a transfer belt, the first toner including a first fluorochrome fluorescing in a blue color wavelength range when excited with ultraviolet light, a second fluorochrome fluorescing in a green color wavelength range when excited with ultraviolet light, a third fluorochrome fluorescing in a red color wavelength range when excited with ultraviolet light such that the first toner glows a white color when excited with ultraviolet light;

a second image forming unit comprising a second photoconductive drum, a second charging device, and a second exposure unit, the second image forming unit storing a second toner in a second developing device and configured to form a second toner image on the second photoconductive drum transfer with the second toner then transfer the second toner image to the transfer belt, the second toner including a visible colored pigment, the second toner image being adjacent to the first toner image on the transfer belt;

a transfer roller to transfer the first and second toner images from the transfer belt to a sheet; and a fixing unit configured to fix the first toner image and the second toner image to the sheet by heating the sheet.

15. The printer according to claim 14, wherein the first toner image and the second toner image are fixed to the sheet simultaneously in the fixing unit.

16. The printer according to claim 14, wherein the first fluorochrome has a fluorescence peak in a wavelength range between 400 nm and 500 nm, the second fluorochrome has a fluorescence peak in a wavelength range between 500 nm and 600 nm, and the third fluorochrome has a fluorescence peak in a wavelength range between 600 nm and 650 nm upon irradiation with ultraviolet light.

17. The printer according to claim 16, wherein a mass % of the first fluorochrome with respect to total mass of the first toner is less than a mass % of the second fluorochrome with respect to total mass % of the first toner.

18. The printer according to claim 16, wherein a mass % of the first fluorochrome with respect to total mass of the first toner is less than a mass % of the third fluorochrome with respect to total mass % of the first toner.

19. The printer according to claim 14, wherein the first toner and the second toner soften at different temperatures.

20. The printer according to claim 14, wherein the first toner further includes a crystalline polyester resin and an ester wax, and an endothermic peak temperature of the crystalline polyester resin, as measured by differential scanning calorimetry, is higher than an endothermic peak temperature of the ester wax, as measured by differential scanning calorimetry.

* * * * *